US007293839B2

(12) United States Patent
Shimizu

(10) Patent No.: US 7,293,839 B2
(45) Date of Patent: Nov. 13, 2007

(54) FOOTREST DEVICE

(75) Inventor: Nobuzo Shimizu, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 307 days.

(21) Appl. No.: 10/524,012

(22) PCT Filed: Aug. 25, 2003

(86) PCT No.: PCT/JP03/10723

§ 371 (c)(1),
(2), (4) Date: Feb. 8, 2005

(87) PCT Pub. No.: WO2004/021961

PCT Pub. Date: Mar. 18, 2004

(65) Prior Publication Data

US 2006/0006724 A1 Jan. 12, 2006

(30) Foreign Application Priority Data

Sep. 6, 2002 (JP) ..... 2002-261889

(51) Int. Cl.
*A47C 7/50* (2006.01)
*A47C 20/00* (2006.01)

(52) U.S. Cl. ..... 297/423.36; 297/423.35; 297/423.17

(58) Field of Classification Search ..... 297/423.26, 297/423.28, 423.3, 423.34, 423.35, 423.17; *A61H 7/00, A61H 15/00*

See application file for complete search history.

(56) References Cited

U.S. PATENT DOCUMENTS 4,426,071 A * 1/1984 Klevstad ..... 5/602
5,238,296 A * 8/1993 Paul ..... 297/423.43
5,447,359 A * 9/1995 Asbjornsen et al. ... 297/423.35
5,762,618 A * 6/1998 Yamanaka et al. ..... 601/148
5,779,316 A 7/1998 Sugawa et al.
6,599,261 B1 * 7/2003 Chen ..... 601/115
6,969,361 B2 * 11/2005 Hsieh ..... 601/127
2003/0006639 A1 * 1/2003 Shimizu ..... 297/423.17

FOREIGN PATENT DOCUMENTS

JP 63-52902 B2 10/1988
JP 11-299565 A 11/1999
JP 2000-308663 A 11/2000
JP 2001-37828 A 2/2001

* cited by examiner

*Primary Examiner*—David Dunn
*Assistant Examiner*—Tania Abraham
(74) *Attorney, Agent, or Firm*—Birch, Stewart, Kolasch & Birch, LLP

(57) ABSTRACT

A footrest apparatus according to the present invention enables change of the position of a footrest and fixation of the same both in a position in which a surface for massaging lower limbs is oriented frontward and a position in which a lower limb resting surface is oriented frontward. The footrest apparatus according to the invention includes a pair of left and right supporting members (3, 3) frontwardly projecting from the front portion of a chair (2); a footrest (7) supported between the supporting members (3, 3) so as to be rotatable about a lateral axis (4) and provided with a lower limb massaging portion (5) on one surface and a lower limb resting surface (6) on the other surface on which the lower limbs (64) can be rested; and a position switching mechanism (8) provided between the supporting member (3) and the footrest (7) for changing the position of the footrest (7) between a massaging position in which the lower limb massaging portion (5) is oriented frontward and a resting position in which the lower limb resting surface (6) is oriented frontward.

11 Claims, 7 Drawing Sheets

FOOTREST DEVICE

TECHNICAL FIELD

The present invention relates to a footrest apparatus provided on a chair and having a massaging function.

BACKGROUND ART

As the one having the footrest apparatus of this type, there is a massaging chair disclosed in JP-A-11-299565.

The massaging chair is provided with a seatback portion on the rear side of a sitting portion and a footrest on the front side thereof, the seatback portion is provided with a massaging portion such as an airbag, and the footrest is provided with a pair of left and right holding grooves for fitting legs to be held therein and massaging portions such as airbags provided on both sides of the holding grooves.

The seatback portion is reclinable in the front-rear direction, and the footrest is swingably provided on the front side of the sitting portion through a supporting member. The seatback portion and the footrest are interlocked in such a manner that footrest swings upward when the seatback portion is reclined downward, while the footrest swings downward when the seatback portion is returned toward the upright position.

The massaging chair as described above is not only used for massaging, but also simply as a chair in many cases.

Especially, in the massaging chair of this type, since it often includes a soft cushion incorporated in the sitting portion, and the seatback portion has a reclining function, it is suitable for being used as a sofa.

However, as regards the footrest, since the holding grooves are formed for lower limbs, more specifically, for calves of the legs on one side thereof, a user is required to fit his/her lower limbs into the holding grooves even when he/she does not use the massaging function, whereby free movement of the legs is restrained, and hence relaxed position cannot be taken easily. It is also one of the causes which impair the appearance of the chair.

Since a surface of the other side of the footrest is substantially flat and is capable of being used as a lower limb resting surface, it is expected that the appearance can be improved by orienting the surface of this side frontward.

However, the technology disclosed in JP-A-11-299565 does not have a structure to rotate the footrest to allow any one of these surfaces to be used.

In view of such problems described above, it is an object of the invention to provide a footrest apparatus in which the position of a footrest can be changed freely between a position with the surface for massaging lower limbs oriented frontward and a position with the lower limb resting surface oriented frontward.

DISCLOSURE OF INVENTION

In order to achieve the object described above, the invention addressed a following technical measure.

Specifically, the technical measure for solving the problems in the invention includes a pair of left and right supporting members frontwardly projecting from the front portion of a chair, a footrest supported between the supporting members so as to be rotatable about a lateral axis and provided with a lower limb massaging portion on one surface thereof and a lower limb resting surface on the other surface thereof on which the lower limbs can be rested, and a position switching mechanism provided between the supporting member and the footrest for changing the position of the footrest between a massaging position in which the lower limb massaging portion is oriented frontward and a resting position in which the lower limb resting surface is oriented frontward.

According to this technical measure, the footrest can be rotated about the lateral axis to change the position to the massaging position, so that the lower limbs, more specifically, the calves of the legs can be massaged in a state the user is sitting on a chair. In addition, the position can be changed to the resting position, so that the lower limbs can be rested thereon.

According to the technical measure for solving the problems in the invention, the position switching mechanism includes a disk-shaped rotary engagement member having an engagement portion for fixing the footrest in the massaging position and an engagement portion for fixing the same in the resting position on the peripheral edge thereof and being provided coaxially with the lateral axis, an engaging member moving toward and apart from the rotary engagement member in the radial direction thereof and detachably engaging the respective engagement portions selectively by moving toward the same for restraining rotation of the rotary engagement member, a releasing device for moving the engaging member in the direction apart from the rotary engagement member for releasing the engagement, are leased-state retaining device for retaining the released state by the releasing device, and an engagement restoring device for engaging the engaging member with the rotary engagement member by bringing the released-state retaining device to the non-retaining state.

According to this technical measure, the engagement between the rotary engagement member and the engaging member can be released by the releasing device and, in addition, the state can be maintained by the released-state retaining device. Therefore, the rotary engagement member can be rotated freely, so that the position of the footrest can be switched between the massaging position and the resting position. Further, the footrest can be fixed at each of the positions by bringing the released-state retaining device to non-retained state by the engagement restoring device, and then engaging the engaging member to the respective engagement portions of the rotary engagement member.

The technical measure for solving the problems of the invention is characterized in that the releasing device includes a releasing member for moving the engaging member apart from the rotary engagement member.

According to the technical measure, the engagement between the rotary engagement member and the engaging member can be released by moving the engaging member apart from the rotary engagement member by operating the releasing member.

Preferably, the releasing member is provided on the outer surface of the supporting member.

With this arrangement, the releasing member can easily be operated at the outer surface of the supporting member.

The technical measure for solving the problems of the present invention is characterized in that the released-state retaining device includes a lock portion provided on the engaging member and a released-state retaining member having an engagement portion which can engage the lock portion in a state in which the engaging member is moved apart form the rotary engagement member.

According to this technical measure, a state in which the engaging member is moved apart can be maintained by the engagement of the engagement portion of the released-state retaining member with the lock portion of the engaging member.

The technical measure for solving the problems of the invention is characterized in that the engagement restoring device includes a restoring strip having a proximal end swingably supported at a position in the vicinity of the respective engagement portion of the rotary engagement member and a distal end being capable of projecting and retracting from the peripheral edge so that the distal end is retracted from the peripheral edge when the rotary engagement member rotates in one direction, and in that the rotary engagement member includes a restraining portion for restraining the swinging movement of the restoring strip to allow the distal end of the restoring strip to project from the peripheral edge to press the released-state retaining member in the retained-state canceling direction when the rotary engagement member rotates in the other direction.

According to this technical measure, since the distal end is retracted inside the peripheral edge and hence cannot press the released-state retaining member when the rotary engagement member rotates in one direction, the rotary engagement member remains rotatable.

When it is rotated in the other direction, the distal end of the restoring strip is restrained from the swinging movement by the restraining portion in a state of being projected from the peripheral edge. Therefore, the retained state of the engaging member can be released by pressing the released-state retaining member with the distal end thereof.

The technical measure for solving the problems of the invention is characterized in that the released-state retaining member is disposed in the vicinity of the engaging member along the movement thereof toward and apart from the rotary engagement member.

According to this technical measure, the space for disposing the releasing and engaging member may be small, whereby a space can be saved.

The technical measure for solving the problems of the invention is characterized in that a pair of supporting members are supported so as to be capable of swinging about a supporting shaft at the front portion of the chair so that the vertical position of the footrest can be changed, in that a retaining device for retaining the vertical position is provided, and in that an operating member for releasing the retained state of the retaining device is provided on one of the left and right outer surfaces of the chair.

According to the technical measure, the vertical position of the footrest can be changed in front of the chair, and the position can be fixed by the retaining device, so that the lower limbs can be rested at predetermined positions. Further, the retained state can be released by the operating member provided on one of the left and right outer surface of the chair.

BEST MODE FOR CARRYING OUT THE INVENTION

Figure 1:
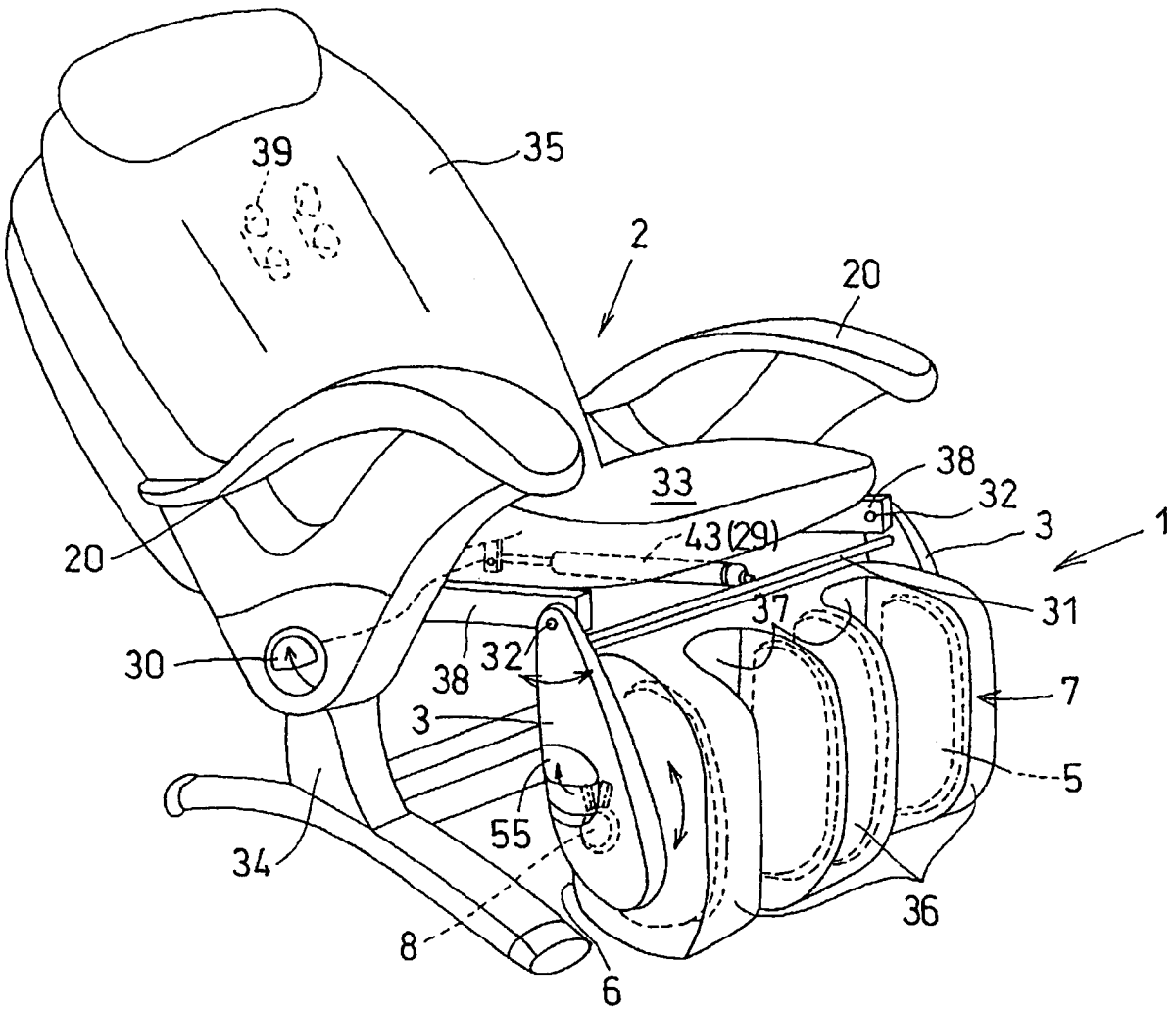
FIG. 1 is a perspective front view of a massaging chair provided with a footrest apparatus.

Embodiments of the present invention will now be described with reference to the drawings.

FIGS. 1 to 7 show a first embodiment of the present invention and illustrate a massaging chair 2 having a footrest apparatus 1 according to the present embodiment. The massaging chair 2 includes a sitting portion 33, a pair of left and right legs 34, 34 for supporting the sitting portion 33 at a predetermined vertical position, and a seatback portion 35 provided on the rear side of the sitting portion 33. Furthermore, a footrest 7 having functions such as supporting lower limbs (calves of legs, in particular) 64 of a user from the lower side thereof is provided on the front side of the sitting portion 33.

In the following description, the left, right, and front-rear directions represent the directions viewed from the user sitting on the massaging chair 2.

The sitting portion 33 has an area sufficient for supporting buttocks of the user from the lower side, and is disposed so as to span over base members 38, 38 extending in the front-rear direction provided on the pair of left and right legs 34, 34.

The seatback portion 35 is supported at the lower end thereof on the rear end of the sitting portion 33 so as to be capable of swinging between an upright position and laid-down position, that is, reclining movement, by a reclining mechanism (not shown). The seatback portion 35 includes a back massaging portion 39 for performing kneading massage or tapping massage incorporated therein so as to be capable of moving in the vertical direction.

The massaging portion may employ a structure for mechanically moving rollers, massaging projections or the like or a structure for inflating and deflating an airbag (air cell) by charging and discharging air.

Arm rests 20 on which the user can rest his/her both arms are provided on left and right sides of the sitting portion 33 above the legs 34, 34. Furthermore, an operating member 30, which will be described later, is provided on the outer surface of one of the legs 34, 34 (right outer surface).

A pair of supporting members 3, 3 are provided on the front sides of the pair of left and right base members 38, 38, respectively, so as to frontwardly projecting therefore. The supporting members 3, 3 are each formed in a spindle shape and each includes a supporting member base plate 41 and a cover 42 for covering the same. The supporting member base plates 41 are supported at the upper ends thereof on opposite sides of the base members 38, respectively, so as to be capable of swinging about supporting shafts 32, so that the supporting members 3, 3, as a whole, can be swung in upward and downward. Are leasing member 55, which will be described later, is provided on one of the supporting members 3, 3 on the outer surface of the cover 42.

In the vicinity of the supporting shaft 32, a connecting member 31 extending in the widthwise direction is provided between the supporting members 3, 3. A retaining device 29 for swinging the supporting members 3, 3 and fixing the position thereof is connected to the connecting member 31. In this embodiment, the retaining device 29 consists of a gas cylinder 43 which is extensible and fixable at a varied length. That is, the gas cylinder 43 can be extended and can be contracted by an application of a force in the direction opposite to the extending direction, and the length thereof can be fixed at a predetermined length.

The proximal end of the gas cylinder 43 is connected to a middle position of the connecting member 31, and the distal end thereof is fixed to a position on the lower rear side of the sitting portion 33. The operating member 30 for releasing the fixed state of the gas cylinder 43 and allowing the same to extend is provided on the outer surface of the right leg 34.

The length of the gas cylinder 43 is rendered extensible by operating (pulling up) the operating member 30 so as to cause the supporting members 3, 3 to swing about the supporting shaft 32 through the connecting member 31. When the operating member 30 is restored to the original state, the supporting members 3, 3 can be fixed and retained at the positions.

The footrest 7 is provided between the lower ends of the pair of left and right supporting members 3, 3 through a lateral shaft 4 so as to be capable of rotating in the front-rear direction.

The footrest 7 is formed in a substantially square shape in front view, and the lateral shaft 4 is passed through substantially the center of the left and right side portions thereof. The footrest 7 rotates in normal and reverse directions about the lateral shaft 4, so that the either one of the front and the rear surfaces can be oriented frontward.

Figure 2:
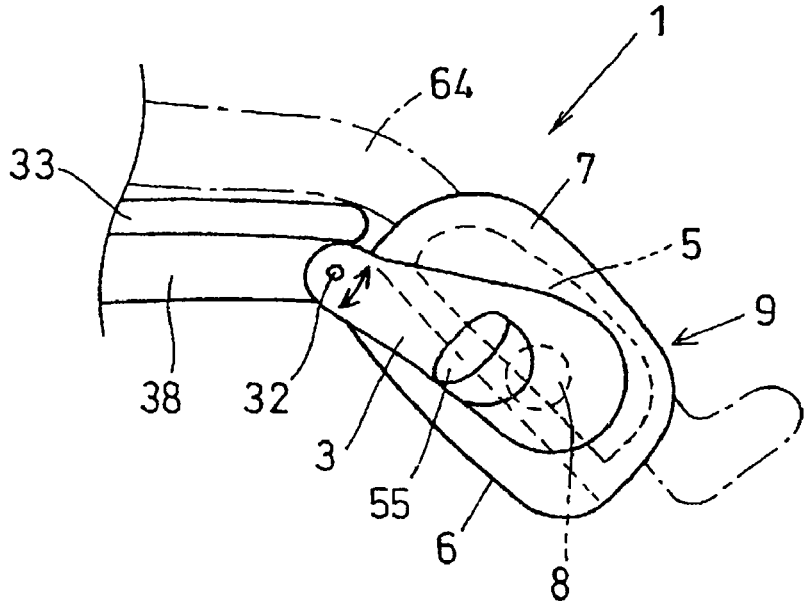
FIG. 2 is a side view showing a massaging position of the footrest apparatus.

As shown in FIG. 1 and FIG. 2, one of the surfaces (front surface) of the footrest 7 is formed into a massaging surface 9 for performing massage with respect to the lower limbs 64, and the position in which the massaging surface 9 is oriented frontward is referred to as a massaging position. For example, the footrest apparatus shown in FIG. 1 is in the massaging position.

The massaging surface is provided with supporting walls 36 projecting from left and right ends and the center of the massaging surface 9, and holding grooves 37 defined between the supporting walls 36 for holding the lower limbs 64. Lower limb massaging units for performing massage are incorporated in the opposing surfaces of the respective supporting walls 36 to configure a lower limb massaging portion 5.

The lower limb massaging unit may comprise an elongated plate member extending in the direction of the length of the leg which is caused to swing in the lateral direction for performing massage or an airbag which is inflated and deflated by charging and discharging air for performing massage.

It is preferred to incorporate the lower limb massager including a kneading device having a pair of left and right massaging members formed of elongated plates opposing to each other and extending in the direction of the length of the lower limb 64, and a driving device for moving the massaging members toward and away from each other in a state that the massaging members are inclined in the opposite direction for varying the extent of inclination with respect to the direction of the length of the lower limb 64.

The massaging unit may be provided in the bottom portion of the holding grooves.

Figure 3:
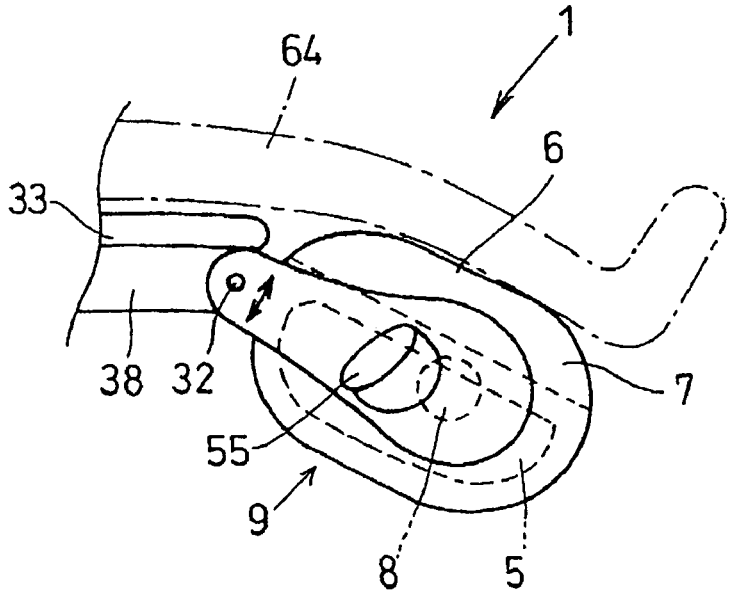
FIG. 3 is a side view showing a resting position of the footrest apparatus.
Figure 4:
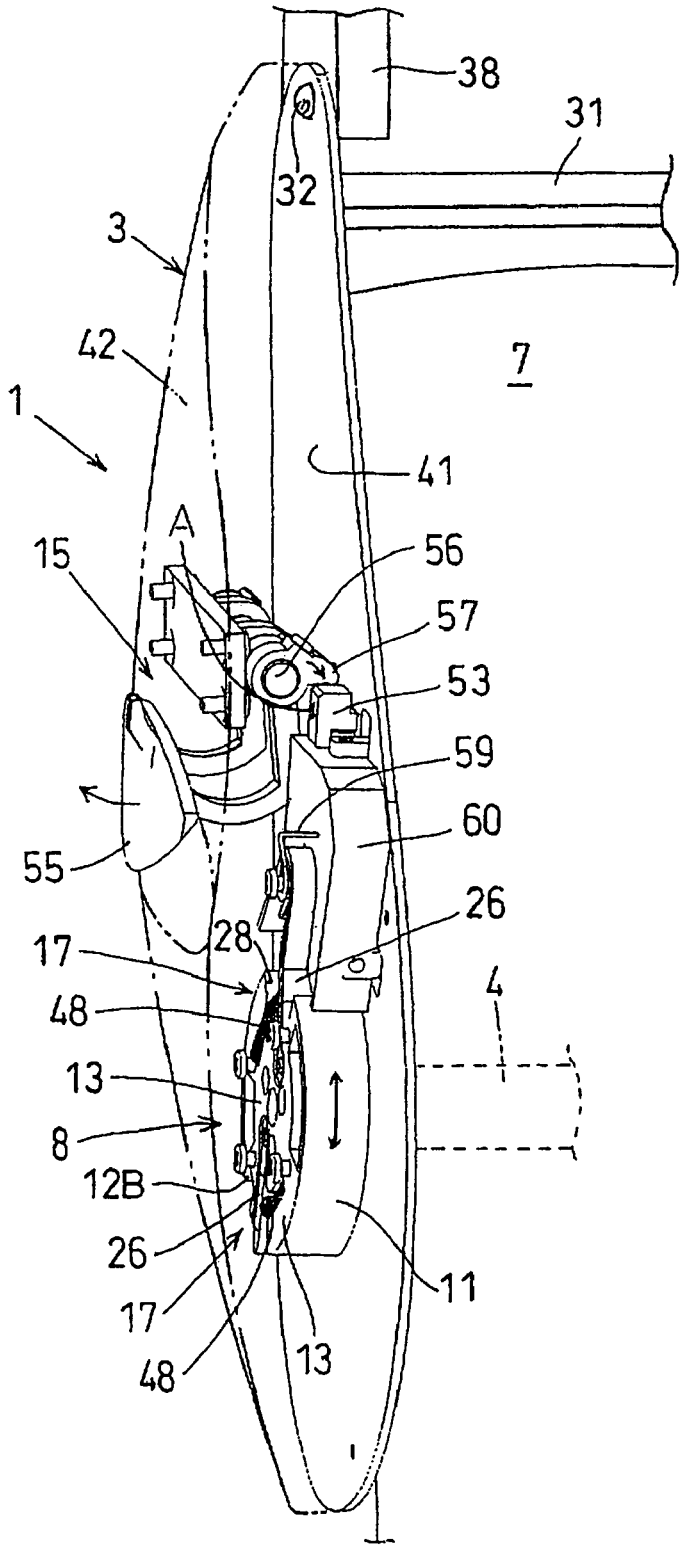
FIG. 4 is a perspective side view of a first embodiment of a position switching mechanism.

As shown in FIG. 3, the other surface (rear surface) of the footrest 7 is configured to be a substantially flat lower limb resting surface 6 which can be oriented frontward by reversing the footrest 7 for resting legs thereon (resting position) The lower limb resting surface 6 may be any face as long as it does not restrain the movement of the legs as a whole, for example, a gently curved arcuate surface, or a gently waved surface. The lower limb resting surface 6 is preferably provided with a shock absorbing member such as a cushion incorporated in the inner side thereof.

One of the supporting members 3, 3 (right side) is provided with a position switching mechanism 8 on the inner side of the lower end thereof for allowing the position of the footrest 7 to be switched between the massaging position and the resting position, and allowing the same to be fixed at a predetermined position.

The position switching mechanism 8 is configured as shown in FIGS. 4 to 7, and comprises a substantially disk-shaped rotary engagement member 13 fixed to the end of the lateral shaft 4. A peripheral edge 11 of the rotary engagement member 13 is formed with an engagement portion 12A for fixing the footrest 7 in the massaging position (the position in which the massaging surface 9 is oriented frontward) and an engagement portion 12B for fixing the footrest 7 in the resting position (the position in which the lower limb resting surface 6 is oriented frontward). These engagement portions 12A, 12B are formed by notching the peripheral edge 11 at positions substantially opposed to each other on the peripheral edge 11 of the rotary engagement member 13.

Figure 7:
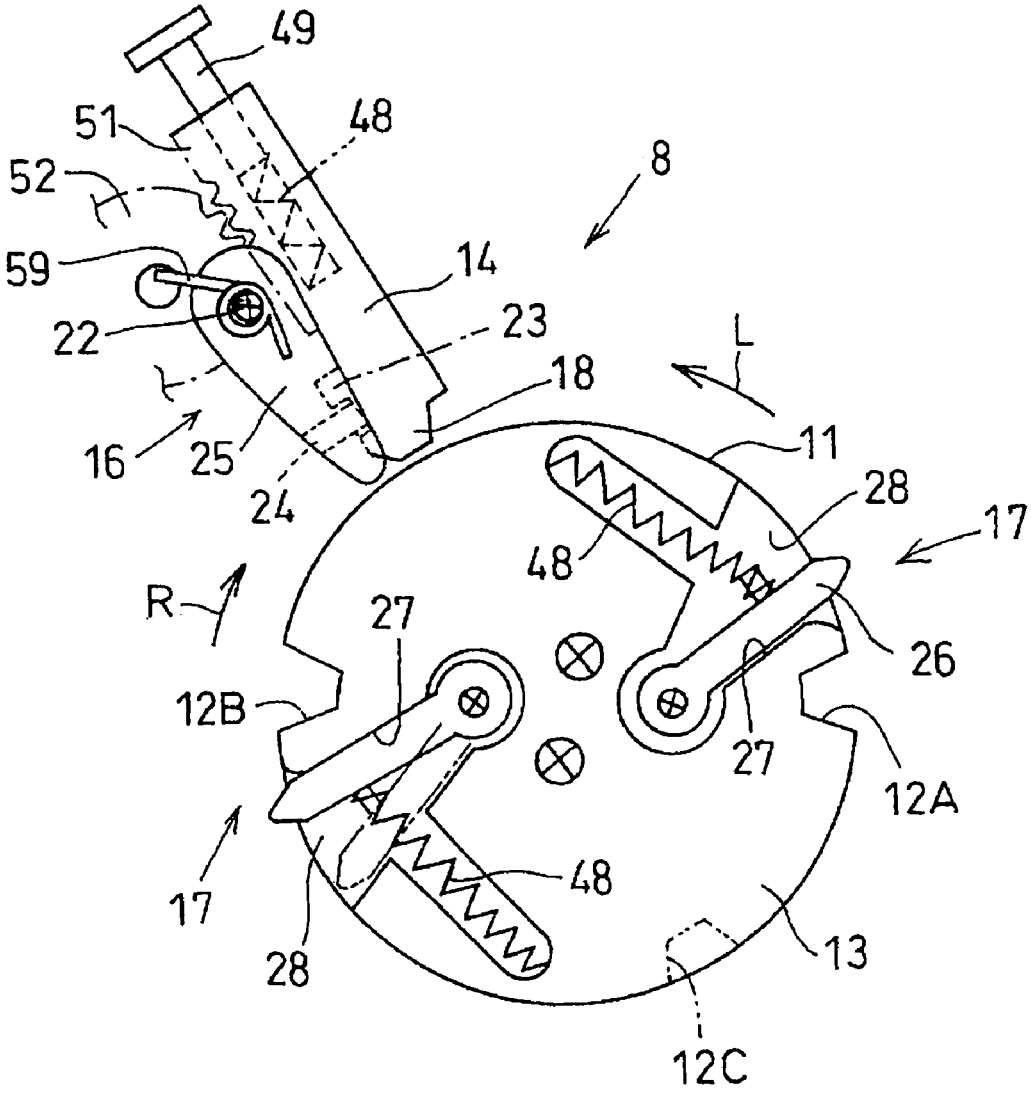
FIG. 7 is a front view of the same.

An engagement restoring device 17 is provided on the rotary engagement member 13 in the vicinity and on the front sides of each of the engagement members 12A, 12B in the counterclockwise direction of the rotary engagement member 13 (in the direction indicated by an arrow L in FIG. 7). The engagement restoring device 17 is configured in such a manner that an elongated restoring strip 26 is provided in a fan-shaped recess 28 formed on the side surface of the rotary engagement member 13.

The proximal end of the restoring strip 26 is swingably supported at a position in the vicinity of the center of the rotary engagement member 13, and the distal end thereof is formed into a rounded shape and is adapted to be capable of projecting and retracting from the peripheral edge 11. The restoring strip 26 is provided with a resilient member 48 such as a coil spring at a middle position thereof, and is urged toward one of the two widthwise sides of the fan-shaped recess 28 which is closer to each of the engagement portions 12A, 12B, and the side closer to each of the engagement portions 12A, 12B defines a restraining portion 27 for restraining the swinging movement of the restoring strip 26.

Figure 5:
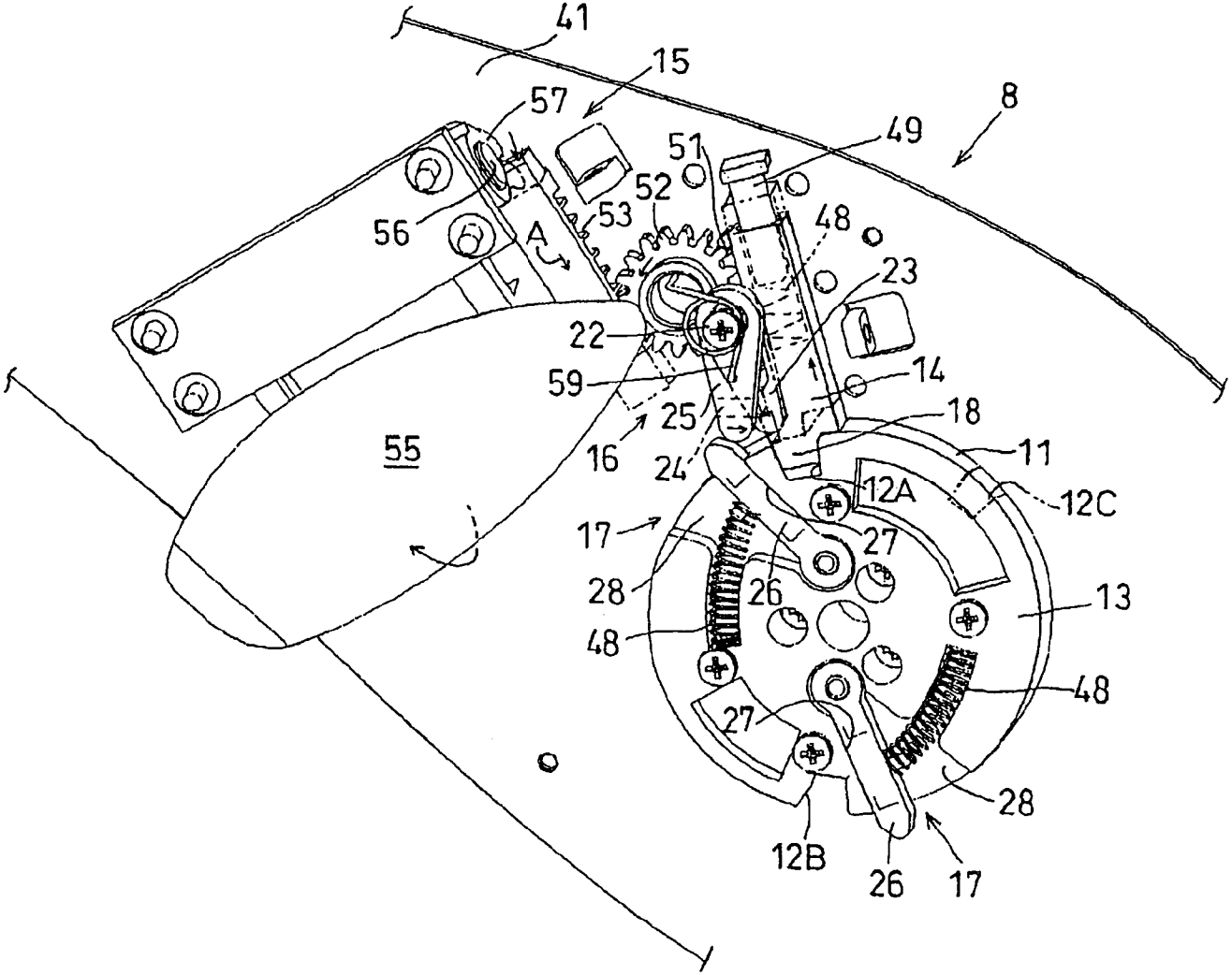
FIG. 5 is a perspective front view of the same.
Figure 6:
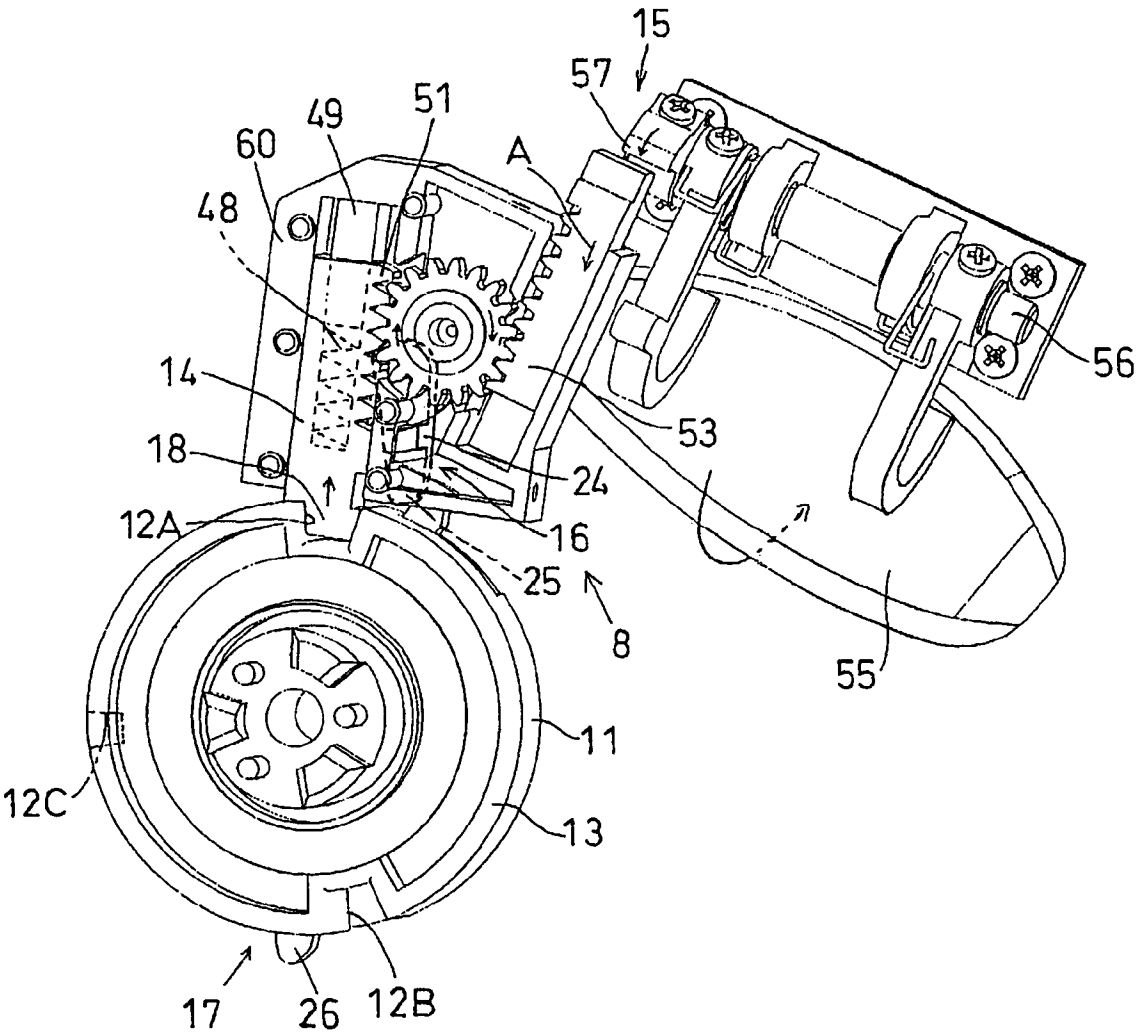
FIG. 6 is a perspective rear view of the same.

For example, the distal end of the restoring strip 26 located on the upper side of the rotary engagement member 13 shown in FIG. 5 is adapted to be swingable leftward in the drawing so as to be retracted from the peripheral edge 11, while it is adapted to be restrained from swinging rightward in the drawing by the restraining portion 27 so as to be projected from the peripheral edge 11.

Substantially above the rotary engagement member 13, an engaging member 14 is provided. The engaging member 14 is an elongated strip having a substantially rectangular shape in cross-section, and having a distal end formed with an engaging portion 18 which is selectively engageable with the engagement portions 12A, 12B and has a convex shape in front view.

The engaging member 14 has a hollow proximal end, and includes the resilient member 48 such as a coil spring incorporated therein, and a pushing strip 49 fitted therein. Since one end of the pushing strip 49 is fixed to the supporting member base plate 41, the engaging member 14 is movable toward and apart from the center of the rotary engagement member 13, and is urged constantly toward the center of the rotary engagement member 13.

The rotary engagement member 13 is fixed by the selective engagement of the engaging portion 18 with the engagement portions 12A, 12B, whereby the footrest 7 is fixed in a position corresponding to each of the engagement portions 12A, 12B.

The side surface of the engaging member 14 is formed with a rack gear 51 along the direction of its movement toward and away from the rotary engagement member, and a releasing gear 52 mates with the rack gear 51. On the opposite side of the engaging member 14, a releasing rack gear 53 mates with the releasing gear 52.

When the releasing rack gear 53 is slid, the releasing gear 52 rotates to slide the engaging member 14 radially outwardly of the rotary engagement member 13. In other words, by moving the releasing rack gear 53 so that the engaging member 14 is slid in the direction apart from the rotary engagement member 13, engagement between the engaging member 14 and the engagement portions 12A, 12B can be released. In the present embodiment, by pressing the upper end of the releasing rack gear 53 in the direction indicated by an arrow A in FIGS. 5 and 6, the engaging member 14 can be moved away from the rotary engagement member 13.

The cover 42 of the right supporting member 3 is provided with a releasing device 15 for pressing the upper end of the releasing rack gear 53 in the direction of the arrow A. The releasing means 15 includes a releasing member 55 disposed on the outside of the cover 42, a fixing shaft 56 for swingably fixing the releasing member 55 to the cover 42, and a pressing strip 57 formed around the fixing shaft 56.

By operating (pulling up) the releasing member 55, the pressing strip 57 is moved around the fixing shaft 56, and presses the upper end of the releasing rack gear 53 downward.

In the present embodiment, since the releasing member 55 and the pressing strip 57 constitute leverage with the fixing shaft 56 as a fulcrum, a reduced force is required for operating the releasing member 55.

A released-state retaining device 16 is provided at a position in the vicinity of the engaging member 14. Specifically, a plate-shaped released-state retaining member 25 is provided at a position in the vicinity of the engaging member 14. The proximal end thereof is swingably supported by a pivot 22 extending substantially in parallel with the lateral shaft 4 and positioned in the vicinity of the engaging member 14, while the distal end thereof is formed with a projecting lock portion 24. The longitudinal direction of the released-state retaining member 25 extends substantially along the direction of the movement of the engaging member 14 toward and away from the rotary engagement member.

With this arrangement of the releasing and engaging member 14, a space required for incorporating the same may be small, resulting in saving of space.

The released-state retaining member 25 is provided with a torsion coil spring 59 around the pivot 22, which has one end fixed to a case body 60, and the other end fixed to the released-state retaining member 25, so that the released-state retaining member 25 is urged toward the engaging member 14.

In addition, a lock portion 23 having an outwardly projecting convex shape is formed on the side surface of the engaging member 14. When the engaging member 14 is moved apart from the rotary engagement member to be brought into engaged state, the lock portion 23 and the lock portion 24 engage with each other, so that the released-state retaining member 25 and the engaging member 14 are retained in an engaged state, whereby the rotatable state of the rotary engagement member 13 is retained.

It is also possible that the lock portion 24 is concave and the lock portion 23 is convex, and vice versa. They may take either form as long as they can engage with each other.

Subsequently, the operation of the footrest apparatus 1 according to the present embodiment will be described based on FIGS. 2 to 7.

For massaging the lower limbs 64, as shown in FIG. 2, the lower limb massaging portion 5 is enabled to massage the lower limbs by orienting the massaging surface 9 of the footrest 7 frontward, sitting on the massaging chair 2, and fitting the lower limbs 64 in the holding grooves.

For simply using the chair 2 for sitting, as shown in FIG. 3, the user can take a comfortable position with his/her feet free to move by orienting the lower limb resting surface 6 of the footrest 7 frontward to bring the footrest 7 into the resting position, and resting the legs thereon.

Rotation in the normal or reverse direction of the footrest 7 from one surface to the other surface is enabled by operating (pulling) the releasing member 55 once. When the releasing member 55 is pulled upward, the pressing strip 57 presses the releasing rack gear 53 downward, and the engaging member 14 slides away from the rotary engagement member. Accordingly, the engaging member 14 is disengaged from the rotary engagement member 13, and the rotary engagement member 13, that is, the footrest 7 is allowed to rotate in the normal or reverse direction.

When the released-state retaining device 16 functions in this state, the engaging member 14 is retained and fixed at a position apart from the rotary engagement member, and the footrest 7 is still rotatable even when the releasing member 55 is restored into its original position by the user. Therefore, the footrest 7 can be easily rotated to a position in which one surface or the other surface is oriented frontward.

Furthermore, the footrest 7 is automatically fixed to the respective positions described above by the position switching mechanism 8.

For fixing the footrest position, the position switching mechanism 8 works as follows. For example, in FIG. 7, when the rotary engagement member 13 is rotated in the direction indicated by the arrow L (counterclockwise), swinging movement of the restoring strip 26 in the vicinity of the engagement portion 12A is restrained by the restraining portion 27 in a state in which the distal end of the restoring strip is projected from the peripheral edge 11. Therefore, the released-state retaining member 16 can be pressed, and hence the retained state of the engaging member 14 can be released, whereby the engaging portion 18 is fitted into the engagement portion 12A, so as to be fixed in the massaging position (the position in which the massaging surface 29 is oriented frontward) corresponding to the engagement portion 12A.

When the rotary engagement member 13 is rotated in the direction indicated by an arrow R (clockwise), the distal end of the restoring strip 26 in the vicinity of the engagement portion 12B is retracted from the peripheral edge 11 even when it abuts against the released-state retaining member 25, and the released-state retaining member 25 cannot be pressed in this direction.

Therefore, the engagement portion 12B passes under the engaging member 14, and thereafter, by rotating the rotary engagement member 13 in the direction indicated by the arrow L, the engaging portion 18 engages the engagement portion 12B as described above so as to be fixed in the resting position (the position with the lower limb resting surface 6 oriented frontward) corresponding to the engagement portion 12B.

The footrest 7 may be fixed at any desired position by forming the engagement portions 12A, 12B at any corresponding positions on the peripheral edge 11. For example, it is possible to provide the engagement portions 12A, 12B at position such that the massaging surface 9 or the lower limb resting surface 6 is oriented upward and fixed at that position.

With this arrangement, side surfaces or bottoms of legs can be massaged by the lower limb massaging portion 5 and the legs can be rested on the lower limb resting surface 6.

Further, a further engagement portion 12C, etc. may be provided so that the footrest can be switched into and fixed in a plurality of positions.

On the other hand, the gas cylinder 43 provided below the sitting portion 33 is extended by operating the operating member 30 provided on the side surface of the massaging chair 2, and the supporting members 3, 3 swing about the supporting shaft 32 by pressing the connecting member 31, so that the footrest 7 swings upward, and hence the footrest 7 can be moved to a predetermined vertical position. Then, when the operating member 30 is released thereon, the length of the gas cylinder 43 is fixed and the vertical position of the footrest 7 is retained.

With this arrangement, the user can massage his/her lower legs 64 on the footrest 7 at a desired vertical position. Since the operating member 30 and the releasing member 55 are provided on the same side (right side) of the massaging chair 2, operations can be made by one hand, thereby improving the operability.

However, there is no problem even if the operating member 30 and the releasing member 55 are provided respectively on the opposite sides of the massaging chair 2.

Figure 8:
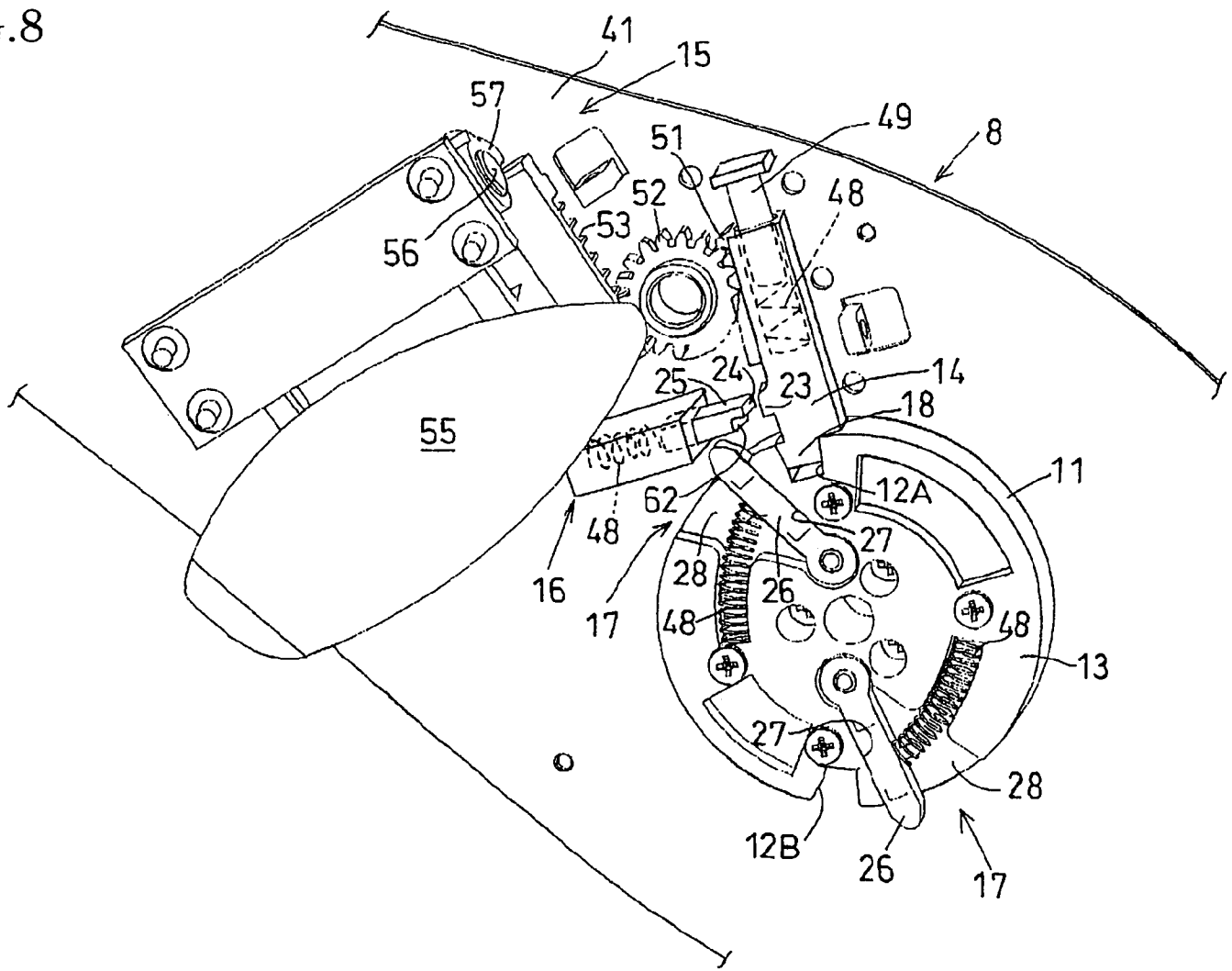
FIG. 8 is a perspective front view of a second embodiment of the position switching mechanism.

FIG. 8 shows a second embodiment of the position switching mechanism 8 in the footrest apparatus 1. Although the structure is substantially the same as the first embodiment, the configuration of the released-state retaining member 25 is different.

Specifically, the released-state retaining member 25 is an elongated strip having a cross-section of rectangular shape and the distal end thereof is formed with a lock portion 24 of a convex shape and a press surface 62 to which the restoring strip 26 abuts and presses. The released-state retaining member 25 moves toward and apart from the engaging member 14 in the substantially perpendicular direction and is urged by the resilient member 48 such as a coil spring toward the engaging member 14.

In substantially the same manner as the first embodiment, the lock portion 24 engages the lock portion 23, and a non-engagement state between the rotary engagement member 13 and the engaging member 14 is retained in a state in which the engaging member 14 has slid apart from the rotary engagement member 13. When the distal end of the restoring strip 26 presses the press surface 62, the released-state retaining member 25 slides in the direction away from the engaging member 14, so that the retained state is released.

It should be noted that the present invention is not limited to the above-described embodiments.

In other words, the position switching mechanism 8 may be incorporated in the footrest 7, or disposed in a space between the supporting member 3 and the footrest 7 without any problem.

INDUSTRIAL APPLICABILITY

The present invention is applicable to a footrest apparatus to be mounted to a massaging chair, and is also applicable to a sofa, a seat of a vehicle or the like.

The invention claimed is:

1. A footrest apparatus comprising:

a pair of left and right supporting members frontwardly projecting from a front portion of a chair;

a footrest supported between the supporting members so as to be rotatable about a lateral axis and provided with a lower limb massaging portion on one surface thereof and a lower limb resting surface on the other surface thereof on which lower limbs can be rested; and a position switching mechanism provided between one of the supporting members and the footrest for changing the position of the footrest between a massaging position in which the lower limb massaging portion is oriented frontward, and a resting position in which the lower limb resting surface is oriented frontward wherein the position switching mechanism comprises a disk-shaped rotary engagement member having an engagement portion for positionally fixing the footrest in the massaging position and an engagement portion for positionally fixing the same in the resting position on a peripheral edge thereof, the disk-shaped rotary engagement member being provided coaxially with the lateral axis, an engaging member moving toward and apart from the rotary engagement member in a radial direction thereof and detachably engaging the respective engagement portions selectively by moving toward the same for restraining rotation of the rotary engagement member, a releasing device for moving the engaging member in the direction apart from the rotary engagement member for releasing the engagement, a released-state retaining device for retaining the released state by the releasing device, and an engagement restoring device for engaging the engaging member with the rotary engagement member by bringing the released-state retaining device into non-retaining state.

2. The footrest apparatus according to claim 1, wherein the releasing device includes a releasing member for moving the engaging member apart from the rotary engagement member.

3. The footrest apparatus according to claim 2, wherein the releasing member is provided on the outer surface of the supporting member.

4. The footrest apparatus according to claim 3, wherein the pair of supporting members are supported so as to be capable of swinging about a supporting shaft at a front portion of the chair so that the vertical position of the footrest can be changed; wherein a retaining device for retaining the vertical position is provided; and wherein an operating member for releasing the retained state of the retaining device is provided on one of left and right outer surfaces of the chair.

5. The footrest apparatus according to claim 2, wherein the released-state retaining device includes a lock portion provided on the engaging member and a released-state retaining member having an engagement portion which can engage the lock portion in a state in which the engaging member is moved apart.

6. The footrest apparatus according to claim 5, wherein the engagement restoring device includes a restoring strip having a proximal end swingably supported at a position in the vicinity of the respective engagement portions of the rotary engagement member, and a distal end being capable of projecting and retracting from the peripheral edge, so that the distal end is retracted from the peripheral edge when the rotary engagement member rotates in one direction; and wherein the rotary engagement member includes a restraining portion for restraining swinging movement of the restoring strip to allow the distal end of the restoring strip to project from the peripheral edge to press the released-state retaining member in a retaining-state canceling direction when the rotary engagement member rotates in the other direction.

7. The footrest apparatus according to claim 6, wherein the released-state retaining member is disposed in the vicinity of the engaging member along the direction of the movement thereof toward and apart from the rotary engagement member.

8. The footrest apparatus according to claim 6, wherein the pair of supporting members are supported so as to be capable of swinging about a supporting shaft at a front portion of the chair so that the vertical position of the footrest can be changed; wherein a retaining device for retaining the vertical position is provided; and wherein an operating member for releasing the retained state of the retaining device is provided on one of left and right outer surfaces of the chair.

9. The footrest apparatus according to claim 5, wherein the pair of supporting members are supported so as to be capable of swinging about a supporting shaft at a front portion of the chair so that the vertical position of the footrest can be changed; wherein a retaining device for retaining the vertical position is provided; and wherein an operating member for releasing the retained state of the retaining device is provided on one of left and right outer surfaces of the chair.

10. The footrest apparatus according to claim 2, wherein the pair of supporting members are supported so as to be capable of swinging about a supporting shaft at a front portion of the chair so that the vertical position of the footrest can be changed; wherein a retaining device for retaining the vertical position is provided; and wherein an operating member (30) for releasing the retained state of the retaining device is provided on one of left and right outer surfaces of the chair.

11. The footrest apparatus according to claim 1, wherein the pair of supporting members are supported so as to be capable of swinging about a supporting shaft at a front portion of the chair so that the vertical position of the footrest can be changed; wherein a retaining device for retaining the vertical position is provided; and wherein an operating member for releasing the retained state of the retaining device is provided on one of left and right outer surfaces of the chair.

* * * * *